US006179463B1

(12) United States Patent
Daniels-Romero

(10) Patent No.: US 6,179,463 B1
(45) Date of Patent: Jan. 30, 2001

(54) INLET HOPPER COVER FOR A CEMENT MIXING TRUCK

(76) Inventor: Kerri N. Daniels-Romero, 1176 Amberton La., Newbury Park, CA (US) 91320

( * ) Notice: Under 35 U.S.C. 154(b), the term of this patent shall be extended for 0 days.

(21) Appl. No.: 09/406,389

(22) Filed: Sep. 27, 1999

(51) Int. Cl.[7] ..... B01F 15/00
(52) U.S. Cl. ..... 366/349; 366/41
(58) Field of Search ..... 366/347, 349, 366/606, 41, 53, 54–59, 62, 68; 217/124, 60.3, 61, 40; 220/287, 213, 315, 323, 324; 150/154, 158, 166; 52/3, 23, DIG. 14

(56) References Cited

U.S. PATENT DOCUMENTS 2,104,262 * 1/1938 Leigh .
2,308,901 * 1/1943 Viall et al. .
2,454,940 * 11/1948 Peters .
2,486,320 * 10/1949 Ost .
2,702,142 * 2/1955 Jones .
2,817,552 * 12/1957 Bruel .
2,974,990 * 3/1961 Mereness .
3,481,371 * 12/1969 Row .
3,614,154 * 10/1971 Evans .
4,221,085 * 9/1980 Conaghan .
5,743,458 * 4/1998 French .
5,944,213 * 8/1999 Alicea et al. .

* cited by examiner

*Primary Examiner*—Charles E. Cooley
(74) *Attorney, Agent, or Firm*—Jack C. Munro

(57) ABSTRACT

A cover for the inlet hopper for a cement mixing truck that is constructed of a sheet material body that is to be draped over the access opening of the inlet hopper and fixed in position by a pair of stretchable cords which are used as attachments to connect to the cement mixing truck structure. The body also includes an elongated rod which causes the upper surface of the body to assume a domed configuration when in use. The peripheral edge of the body includes an elastic cord which is to bind against the exterior surface of the inlet hopper.

5 Claims, 3 Drawing Sheets

INLET HOPPER COVER FOR A CEMENT MIXING TRUCK

BACKGROUND OF THE INVENTION

1) Field of the Invention

The field of this invention relates to protective covers and more particularly to a protective cover for the inlet hopper of a cement mixing truck.

2) Description of the Prior Art

Inlet hoppers of cement mixing trucks comprise a funnel-shaped structure whose purpose is to receive aggregate and water and feed such into the barrel of the cement mixing truck. These inlet hoppers vary somewhat in size and have a generally elliptical configuration that is about three to four feet in length and two to three feet in width. The length of the inlet hopper is the dimension along the longitudinal axis of the cement mixing truck.

Cement mixing trucks are not in use all the time. Normally, such trucks are not in use during the night and in colder climates cement mixing trucks may sit dormant for months at a time. The access opening of the hopper is constantly open which means that rain, snow and dirt can fall within the hopper and be fed into the barrel. This results in the accumulation of water within the barrel which is known to cause premature rusting of the barrel requiring replacement of the barrel. Replacement of a the barrel on a cement mixing truck is a reasonably expensive procedure.

SUMMARY OF THE INVENTION

The primary objective of the present invention is to construct a cover for an inlet hopper of a cement mixing truck which can be quickly and easily placed over the access opening of the inlet hopper to prevent the entry of precipitation and dirt.

Another objective of the present invention is to construct a cover for an inlet hopper of a cement mixing truck which is manufactured at a reasonable cost and therefore can be sold to the ultimate consumer at a reasonable cost.

Another objective of the present invention is to construct a cover for an inlet hopper of a cement mixing truck which, when installed, is capable of remaining in place for an exceedingly long period of time without requiring any monitoring even in high wind conditions.

The structure of the present invention comprises a sheet material body to be constructed of a waterproof, sturdy fabric or fabric type of material. Throughout the body there is mounted a series of rods which are designed to exert a continuous bias on the body tending to locate the body in a domed-shape configuration. The body terminates in a peripheral edge, and within that peripheral edge is located a stretchable elastic cord. Attached to the peripheral edge are two sets of two pairs of downwardly extending ears with each set of ears being located on opposite sides of the body. Each set of ears is connected to a stretchable elastic cord which terminates in a hook which is to be used to connect to a structural member of the cement mixing truck. The elastic cord within the peripheral edge of the body is to function to bind and hold the body in its established position on the inlet hopper.

DETAILED DESCRIPTION OF THE PREFERRED EMBODIMENT

Figure 1:
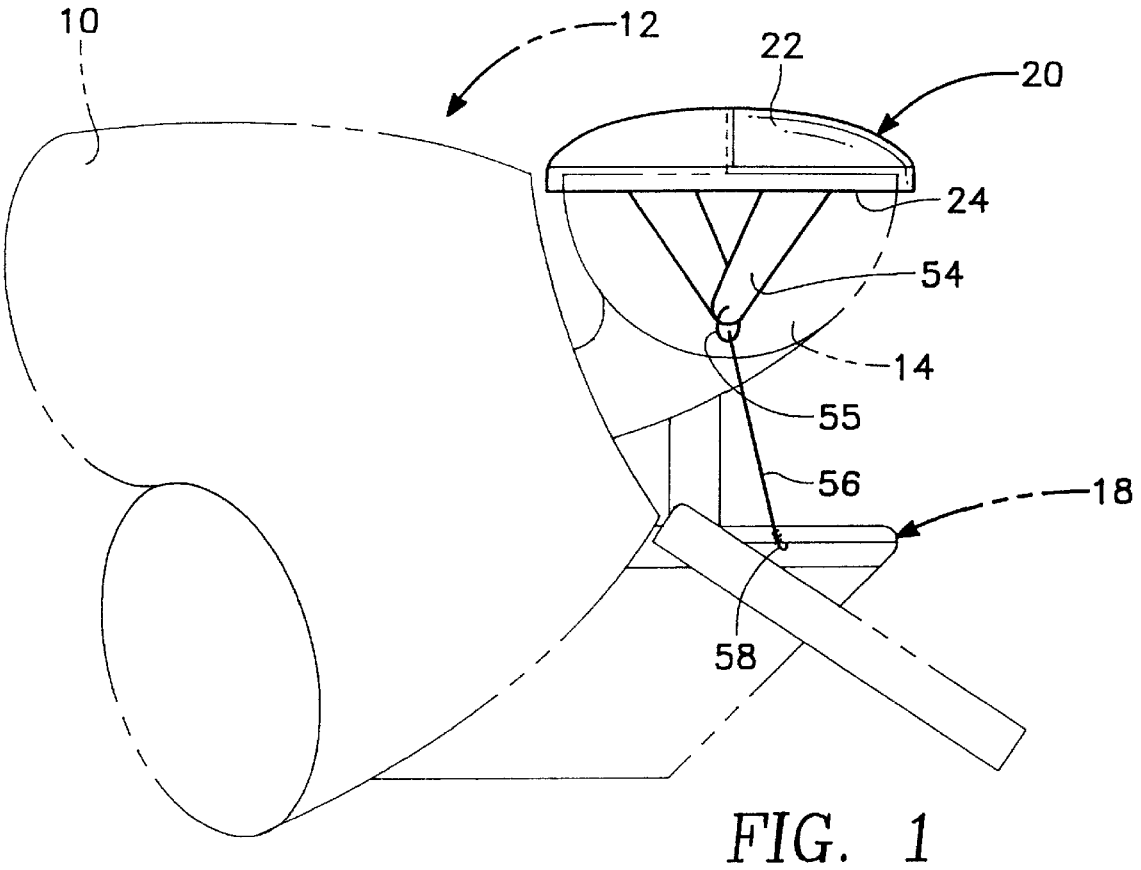
FIG. 1 shows a portion of a cement mixer which includes the inlet hopper upon which has been mounted the inlet hopper cover of the present invention.

Referring specifically to FIG. 1, there is shown rotatable barrel 10 of a cement mixing truck 12. Mounted rearwardly of the barrel 10 adjacent its upper edge thereof is an inlet hopper 14. The inlet hopper 14 terminates in an upper edge 16 which surrounds an access opening into the inlet hopper 14. The inlet hopper 14 is mounted on mounting structure 18 of the cement mixing truck 12. It is to be understood that the purpose of the inlet hopper 14 is to receive and funnel cement, aggregate and water into the barrel 10.

The access opening of the inlet hopper 14 is shown covered with the inlet hopper cover 20 of this invention. The inlet hopper cover 20 includes a body 22 which is constructed of a heavy fabric type of material such as a canvas, nylon or possibly even a plastic. The body 22 has a peripheral edge 24. Formed within the peripheral edge 24 is an annular compartment 26. Mounted within the annular compartment 26 is an elastic cord 28 which constitutes a binding device. The elastic cord 28 could be continuous and be mounted with the entire length of the annular compartment 26. Also, the elastic cord 28 could comprise a series of disconnected segments.

The inlet hopper cover 20 is to have a front end 30, a right side 32, a left side 34 and a back end 36. The front end 30 is to located in alignment with the portion of the inlet hopper 14 that is mounted at rear of cement mixing truck 12. The back end 36 is mounted over the portion of the inlet hopper 14 that is located directly adjacent the barrel 10.

Embedded, as within a seam, within the body 22 is an elongated, bendable rod 38 defined as a bowing device. The length of the rod 38 would normally be about three feet in length and will extend from peripheral edge 24 to peripheral edge 24. In essence, the elongated, bendable rod 38 comprises a spine that extends across the center of the body 22. Typically, the material of construction of the bendable rod 38 would be a polycarbonate fiber that is readily bendable but yet when released has a tendency to spring back to its at-rest position. The rod 38 will be installed within the body 22 in a slightly biased position with the result that the body 22 will naturally assume a rounded or domed configuration. Also embedded within the body 22 in alignment with the center point of the rod 38 and extending transversely thereto are a pair of lateral support struts 40 and 42. The lateral support struts 40 and 42 are of the same diameter and same material as the bendable rod 38 with generally about one quarter to five-sixteenths in diameter being preferable. The lateral support struts 40 and 42 are of the same length and each about one and one-half feet long. The lateral support struts 40 and 42 are in alignment with each other. These struts 40 and 42 further assist in the forming of the domed configuration of the body 22 when it is mounted on the inlet hopper 14.

It is to be understood that the installing of the body 22 on the inlet hopper 14 will require the user to slightly stretch the elastic cord 28 and force the peripheral edge 24 over the inlet hopper 14. Because the elastic cord 28 will be in an extended position, the peripheral edge 24 will be tightly held against the inlet hopper 14.

Mounted interiorly of the body 22 are a pair of support straps 44. The support straps 44 are mounted substantially parallel to the rod 38. The support straps 44 will abut against the upper edge 16 of the inlet hopper 14 when the cover 20 is installed in position on the inlet hopper 14. The ends of the support straps 44 are sewn or otherwise secured to the body 12. It is the function of the support straps 44 to provide additional support to the body 22.

Figure 3:
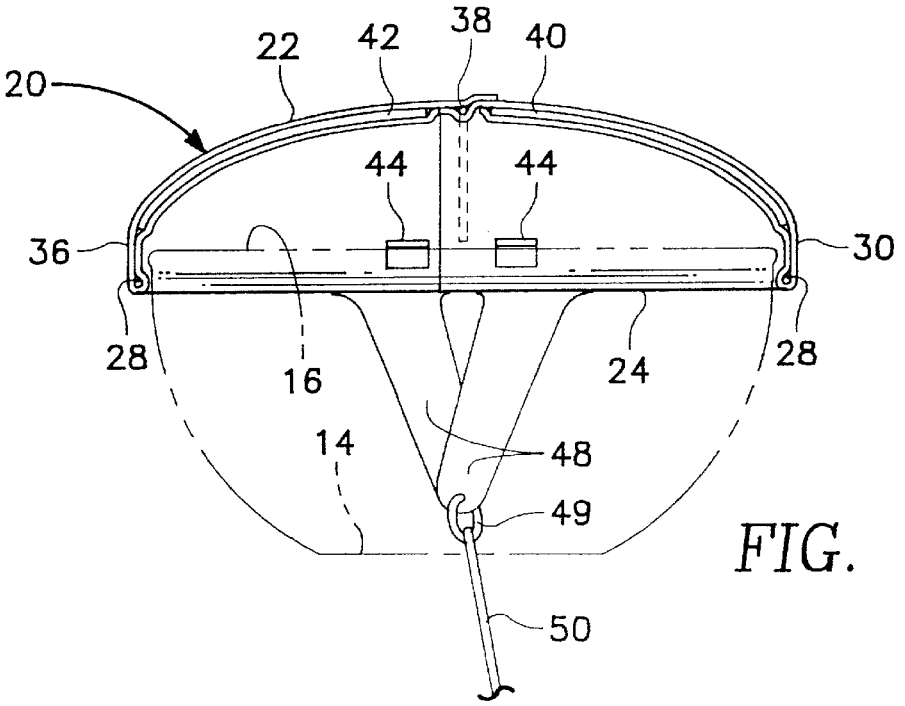
FIG. 3 is a longitudinal cross-sectional view of the inlet hopper cover of the present invention taken along line 3—3 of FIG. 2 depicting how the inlet hopper cover is to be installed on an inlet hopper.
Figure 2:
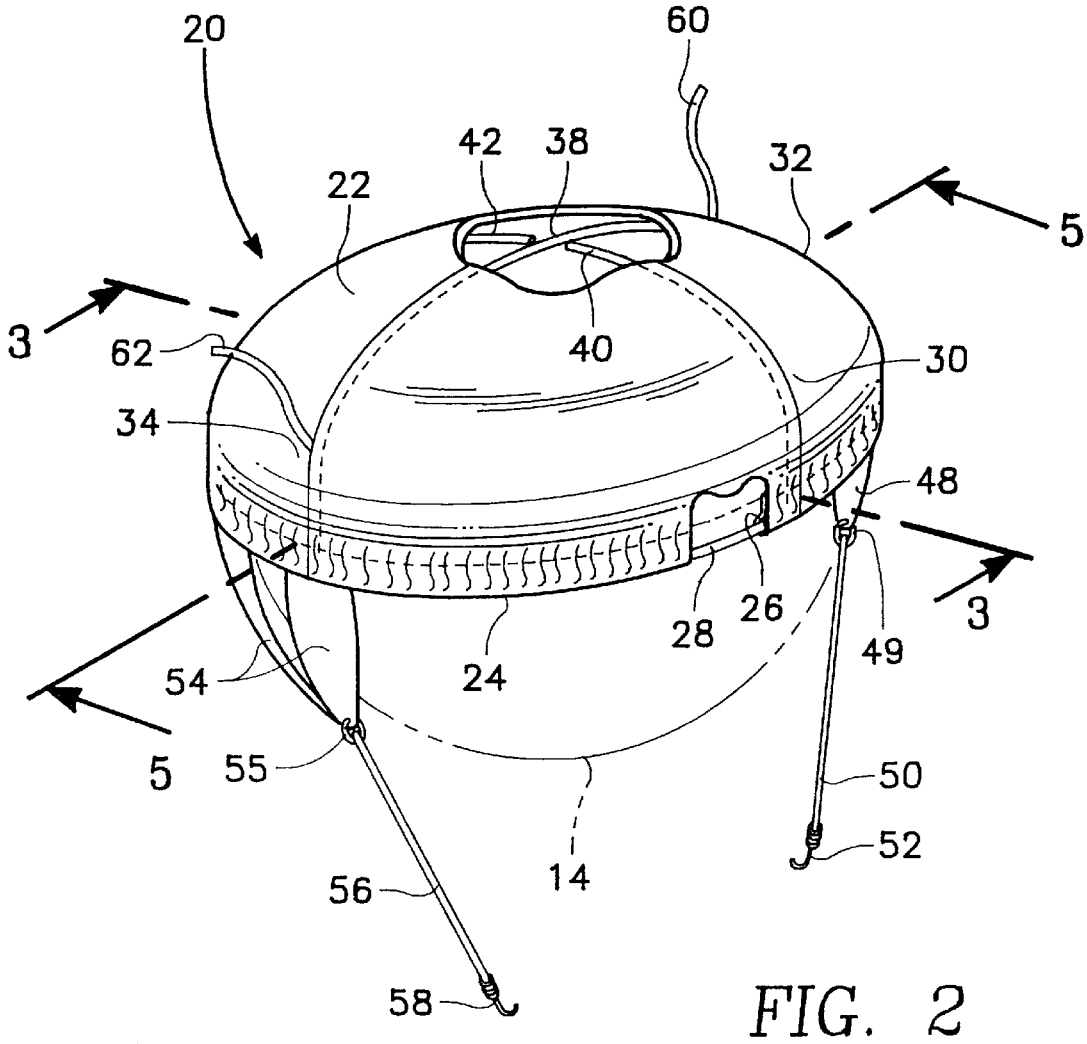
FIG. 2 is a frontal isometric view of the inlet hopper cover of the present invention depicting the position of installation on the inlet hopper of the cement mixing truck.
Figure 4:
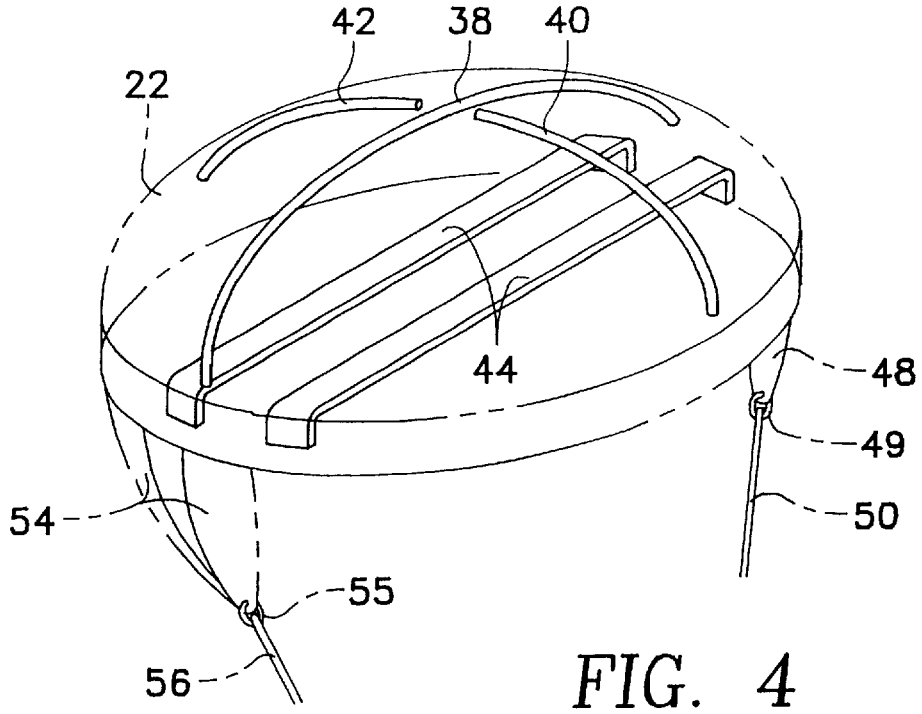
FIG. 4 is an isometric view of the internal components of the inlet hopper cover and showing the body of the inlet hopper cover in phantom.
Figure 5:
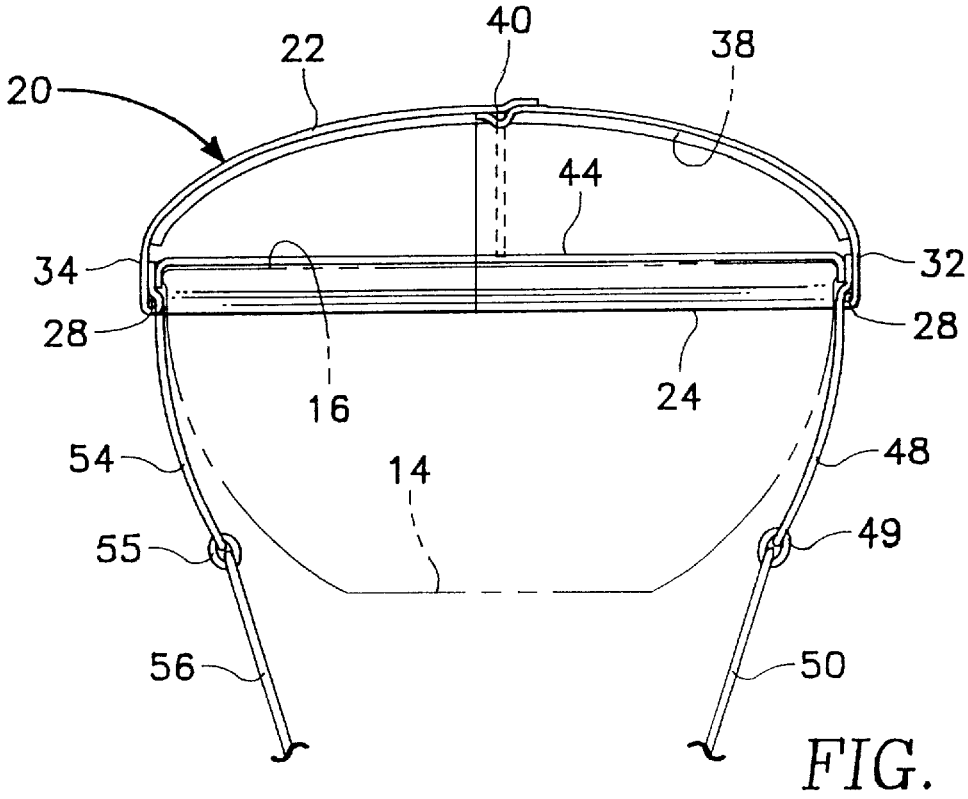
FIG. 5 is a transverse cross-sectional view of the inlet hopper cover showing it as it would be installed on an inlet hopper taken along line 5—5 of FIG. 2.

Located at the right side 32 and attached to the body 22 are a pair of depending ears 48. The ears 48 will normally be constructed of a fabric material which would probably be identical to the fabric used for the body 22. In referring particularly to FIG. 3, it can be seen that one ear 48 is located nearer the front end 30 than the back end 36 while the other ear 48 is located nearer the back end 36 than the front end 30. In this way, the force of attachment will be spread out across the peripheral edge 24 and is not confined to a single point. The ears 48 are connected to a ring 49 which is attached to an elastic cord 50. The elastic cord 50 terminates into a hook 52. The hook 52 is to be connected with a portion of the mounting structure 18 in a manner that stretches the cord 50 so that a relatively strong securing force is applied to the body 22 tending to maintain such on the inlet hopper 14.

On the left side 34 is also similarly mounted a pair of ears 54. These ears 54 are also attached to the peripheral edge 24. The ears 54 are connected to a ring 55 which is attached to an elastic cord 56. The outer end of the elastic cord 56 terminates in a hook 58. The hook 58 is also to be connected to the mounting structure 18.

It is to be understood that when the inlet hopper 20 of this invention is properly installed on the inlet hopper 14, the inlet hopper cover 20 is maintained in a domed configuration which will prevent the accumulation thereon of water. Also, the cover will prevent any precipitation or dirt from entering the inlet hopper 14. It is to be understood that the inlet hopper cover 20 is to be removed during the time that the cement mixing truck 14 is operated.

When the inlet hopper cover 20 is removed, it can be folded to a collapsed position, this folding being permitted by rod 38 bending into a U-shape. When so folded, the straps 60 and 62 are to be tied which will retain the cover 20 in the collapsed position. Normally, the cover 20 when in the collapsed position would be installed within some form of a carry bag, which is not shown.

What is claimed is:

1. An inlet hopper cover for a cement mixer truck comprising:

a fabric body having a peripheral edge, binding means attached to said peripheral edge, said binding means adapted to secure said body to an inlet hopper of a cement mixer truck when said body is in use by being draped over an access opening of the inlet hopper;

bowing means included within said body, said bowing means to cause said body to assumed a domed configuration when in use; said bowing means including an elongated bendable rod that when bent from its at-rest position will have a tendency to automatically return to the at-rest position, said bowing means further including a pair of struts with each said strut comprising a thin, elongated member having a diameter, said struts to be mounted within said body in an in-line relationship, said elongated bendable rod being located between said struts, whereby when said body is removed from the cement mixer truck said body can be collapsed by said elongated bendable rod being bent into a U-shape and said struts locatable in juxtaposition; and attachment means connected to said body, said attachment means for securing said body in a fixed position when in use, said attachment means extending from said body, whereby said body is to close the access opening and prevent entry of dirt, snow and rain into the inlet hopper when the cement mixer truck is not in use.

2. The inlet hopper cover as defined in claim 1 wherein:

said binding means comprising an elastic cord.

3. The inlet hopper cover as defined in claim 1 wherein:

said attachment means including a pair of stretchable cords with one said cord being used on one side of said body and the other said cord being used on an opposite side of said body.

4. The inlet hopper cover as defined in claim 3 wherein:

said attachment means further including a pair of ear members attached to said body on each side of said body, each said pair of ear members to be connected to a said stretchable cord whereby each said pair of ear members functions to spread out a force of attachment between said attachment means and said body.

5. The inlet hopper cover as defined in claim 1 wherein:

said body including at least one support strap, said support strap terminating in a pair of ends, each said end being attached to said peripheral edge, said support strap being located interiorly of said body when said body is in said domed configuration, said support strap being spaced from said bendable rod.

* * * * *